US012559809B2

(12) United States Patent
Yang et al.

(10) Patent No.: US 12,559,809 B2
(45) Date of Patent: Feb. 24, 2026

(54) WIRE ROD FOR CONCRETE REINFORCING STEEL FIBER, STEEL FIBER, AND MANUFACTURING METHOD THEREFOR

(71) Applicant: POSCO CO., LTD, Pohang-si (KR)

(72) Inventors: Yo-sep Yang, Seoul (KR); Jaeseung Lee, Pohang-si (KR); Je-wook Jang, Pohang-si (KR); Manjae Lee, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 305 days.

(21) Appl. No.: 18/268,057

(22) PCT Filed: Dec. 13, 2021

(86) PCT No.: PCT/KR2021/018822

§ 371 (c)(1),
(2) Date: Jun. 16, 2023

(87) PCT Pub. No.: WO2022/131708

PCT Pub. Date: Jun. 23, 2022

(65) Prior Publication Data

US 2024/0043949 A1 Feb. 8, 2024

(30) Foreign Application Priority Data

Dec. 18, 2020 (KR) ..... 10-2020-0178707

(51) Int. Cl.

| | |
|---|---|
| ***C21D 8/08*** | (2006.01) |
| ***C21D 8/0221*** | (2026.01) |
| ***C21D 8/0247*** | (2026.01) |
| ***C21D 8/06*** | (2006.01) |
| ***C21D 9/52*** | (2006.01) |
| ***C22C 38/00*** | (2006.01) |
| ***C22C 38/02*** | (2006.01) |
| ***C22C 38/04*** | (2006.01) |

(52) U.S. Cl.

CPC ..... *C21D 8/08* (2013.01); *C21D 8/0226* (2013.01); *C21D 8/0263* (2013.01); *C21D 8/065* (2013.01); *C21D 9/525* (2013.01); *C22C 38/002* (2013.01); *C22C 38/02* (2013.01); *C22C 38/04* (2013.01); *C21D 2211/005* (2013.01); *C21D 2211/009* (2013.01)

(58) Field of Classification Search

CPC ..... C22C 38/02; C22C 38/002; C22C 38/04; C21D 2211/009; C21D 2211/005; C21D 9/52; C21D 8/08

See application file for complete search history.

(56) References Cited

U.S. PATENT DOCUMENTS 4,559,276 A * 12/1985 Tezuka ..... C04B 14/48 106/644

FOREIGN PATENT DOCUMENTS

| | | | | |
|---|---|---|---|---|
| JP | 2000-192148 | A | 7/2000 | |
| JP | 2018-197375 | A | 12/2018 | |
| KR | 10-2000-0031083 | A | 6/2000 | |
| KR | 10-2005-0075019 | A | 7/2005 | |
| KR | 10-2019-0123303 | A | 10/2019 | |
| KR | 10-2020-0042118 | A | 4/2020 | |
| KR | 10-2178711 | B1 | 11/2020 | |
| WO | WO-2017082684 | A1 * | 5/2017 | ..... C22C 38/28 |

OTHER PUBLICATIONS

Notice of Patent Allowance issued from Korean Patent Application No. 10-2020-0178707 issued on Nov. 3, 2022.

International Search Report for PCT/KR2021/018822 dated Apr. 20, 2022 (PCT/ISA/210).

Extended European Search Report issued Sep. 12, 2025 in Application No. 21907012.5.

* cited by examiner

*Primary Examiner* — Jessee R Roe

(74) *Attorney, Agent, or Firm* — Sughrue Mion, PLLC

(57) ABSTRACT

Provided is a wire rod for a concrete reinforcing steel fiber, a steel fiber, and a manufacturing method therefor. According to one disclosed embodiment of a wire rod for a concrete reinforcing steel fiber, the wire rod comprises, by weight, C: 0.01 to 0.04%, Si: 0.07 to 0.3%, Mn: 1.0 to 2.0%, P: 0.1 to 0.3% and the balance of Fe and other unavoidable impurities, wherein, when the radius of the wire rod is r, in a region from the center of a cross section perpendicular of the longitudinal direction to 0.95*r, the area fraction of ferrite is 90% or more, and the remainder comprises pearlite, wherein the average grain size of the ferrite may be 30 μm or less and the colony size of the pearlite may be 10 μm or less.

13 Claims, No Drawings

WIRE ROD FOR CONCRETE REINFORCING STEEL FIBER, STEEL FIBER, AND MANUFACTURING METHOD THEREFOR

CROSS REFERENCE TO RELATED APPLICATIONS

This application is a National Stage of International Application No. PCT/KR2021/018822 filed Dec. 13, 2021, claiming priority based on Korean Patent Application No. 10-2020-0178707 filed Dec. 18, 2020, the entire disclosures of which are incorporated herein by reference.

TECHNICAL FIELD

The disclosure relates to a wire rod for concrete reinforcing steel fiber, steel fiber and method for manufacturing the same, and more particularly, to a wire rod for concrete reinforcing steel fiber used for reinforcement of tunnels and flooring, a steel fiber and a method for manufacturing the same.

BACKGROUND ART

Steel fibers are used for concrete reinforcement to support the internal earth pressure during tunnel construction. Low strength steel fibers are mainly used domestically, and 0.1% by weight or less of low carbon steel has been used for the low strength steel fiber. In Europe and the Middle East having weak bedrock, however, a high strength steel fiber market has recently been created. This is because tunnel boring machine (TBM) tunnel construction method has been on the rise instead of the gunpowder explosion method. In addition, as high strength steel fibers are used in construction of slab on pile (SOP) that is used when the ground is weak, the high strength steel fiber market is expected to keep growing.

The steel fiber is prepared by using spare slabs or wire rods in a dry drawing-wet drawing process in a processing company to produce a steel wire having a final diameter of 0.4 to 1.0 mm, cutting it into even pieces in a length of 40 to 100 mm, and processing them into a shape. To be used as a steel fiber, they require flexural characteristics in final molding, but strength is the first to be required.

Methods of increasing strength of carbon steel include a method of reducing grain size according to Hall-Petch equation and a method of securing strength through application of a process amount. A method of increasing strength through wire drawing in particular is the most economical and effective method for increasing strength. If the microstructure of the steel is pearlite in wire drawing, the strength increases exponentially during machining. This is because the cementite inside the pearlite is plastically deformed and at the same time, carbon and dislocation are combined according to cementite decomposition. When pearlite and ferrite are mixed, a breakage problem may arise during wire drawing because pearlite is a relatively hard phase compared to ferrite.

In the meantime, lead patenting (LP) heat treatment for imparting ductility to steel to prevent such a breakage problem before wire drawing is costly and time consuming, which causes an increase in manufacturing cost. Therefore, steel fiber manufacturers tend to skip the LP heat treatment to reduce the manufacturing cost. Since high carbon steel forms pearlite that causes the breakage during wire drawing, it is not suitable for a component system for omitting the LP heat treatment, so there is a need to derive a new component system.

DISCLOSURE

Technical Problem

To solve the aforementioned problems, the disclosure provides a wire rod for concrete reinforcing steel fiber, steel fiber, and method for manufacturing the same, which may omit lead patenting (LP) heat treatment to secure high strength and save cost.

Technical Solution

According to an embodiment of the disclosure, a wire rod for concrete reinforcing steel fiber includes, in percent by weight (wt %), 0.01 to 0.04% of C, 0.07 to 0.3% of Si, 1.0 to 2.0% of Mn, 0.1 to 0.3% of P, the remainder of Fe and other unavoidable impurities, and a 90% or more of ferrite area fraction and the remainder of pearlite within a region from a center of a cross section perpendicular of a longitudinal direction to 0.95*r, where r is a radius of the wire rod, wherein an average ferrite grain size is 30 μm or less, and a pearlite colony size is 10 μm or less.

The wire rod for concrete reinforcing steel fiber may satisfy the following Formula (1):

$$TS_{WR}-8(120[C]+14[Si]+20[Mn]+100[P])\geq 0$$

In Formula (1), [C], [Si], [Mn] and [P] each refer to percent by weight (wt %) of the element, and $TS_{WR}$ refers to tensile strength of the wire rod.

The wire rod for concrete reinforcing steel fiber may have the average ferrite grain size may be 15 μm or less, and the pearlite colony size may be 5 μm or less.

The wire rod for concrete reinforcing steel fiber may have a scale layer formed on a surface having a thickness of 10 to 15 μm, a total scale amount being 0.4 to 0.6 wt %, and a residual scale amount after mechanical exfoliation being 0.05 wt % or less.

The wire rod for concrete reinforcing steel fiber may have a tensile strength of 450 MPa or more.

The wire rod for concrete reinforcing steel fiber may have a cross section reduction ratio of 80% or more.

According to an embodiment of the disclosure, a method of manufacturing a wire rod for concrete reinforcing steel fiber includes heating a billet including, in wt %, 0.01 to 0.04% of C, 0.07 to 0.3% of Si, 1.0 to 2.0% of Mn, 0.1 to 0.3% of P, the remainder of Fe and other unavoidable impurities, preparing a wire rod by hot rolling the billet at 1000 to 1150° C. or finishing rolling the billet at A3-70° C. to A3° C., winding the prepared wire rod, and cooling the wound wire rod to A1° C. at 1 to 5° C./s and then cooling at 15 to 20° C./s from A1° C. to 200° C.

The method may satisfy the following Formula (2):

$$TE-TL/H\leq 100^\circ C. \quad (2)$$

In Formula (2), TE is a wire rod surface temperature before entering finishing rolling, and TL/H is a temperature of a winder.

In the method, the wire rod prepared by hot rolling at 1000 to 1150° C. has an average ferrite grain size of 30 μm or less and a pearlite colony size of 10 μm or less.

In the method, the wire rod prepared by finishing rolling at A3-70° C. to A3° C. has an average ferrite grain size of 15 μm or less and a pearlite colony size of 5 μm or less.

According to an embodiment of the disclosure, a concrete reinforcing steel fiber includes, in wt %, 0.01 to 0.04% of C, 0.07 to 0.3% of Si, 1.0 to 2.0% of Mn, 0.1 to 0.3% of P, the remainder of Fe and other unavoidable impurities, and satisfies the following Formula (3).

$$TS_F - TS_{WR} - [15/(1.5*FGS^{0.1})]*e^{4.61} \geq 0 \quad (3)$$

In Formula (3), $TS_F$ refers to tensile strength of steel fiber, $TS_{WR}$ refers to tensile strength of the wire rod, and FGS refers to an average ferrite crystal grain size.

The concrete reinforcing steel fiber may have a tensile strength of 1600 MPa or more.

According to an embodiment of the disclosure, a method of manufacturing a concrete reinforcing steel fiber includes, manufacturing a wire rod including, in wt %, 0.01 to 0.04% of C, 0.07 to 0.3% of Si, 1.0 to 2.0% of Mn, 0.1 to 0.3% of P, the remainder of Fe and other unavoidable impurities, and a 90% or more of ferrite area fraction and the remainder of pearlite within a region from a center of a cross section perpendicular of a longitudinal direction to 0.95*r, where r is a radius of the wire rod, having an average ferrite crystal grain size of 30 μm or less and a colony size of the pearlite of 10 μm or less by including dry drawing and wet drawing with a total of 99% or more of reduction ratio, wherein a breakage rate during the drawing may be 0.5 times/ton.

Advantageous Effects

The disclosure may provide a wire rod for high strength concrete reinforcing steel fiber used for reinforcing tunnels and flooring, a steel fiber, and a method of manufacturing the same. According to the disclosure, high strength is secured by applying P to low carbon steel, and excellent wire drawing workability is secured by performing finishing rolling in a 2-phase (ferrite and pearlite) section of A3-70° C. to A3° C. As a result, dry drawing and wet drawing may be performed without intermediate low patenting (LP) heat treatment, and the drawing process may have a significantly reduced breakage rate.

BEST MODE

According to an embodiment of the disclosure, a wire rod for concrete reinforcing steel fiber includes, in percent by weight (wt %), 0.01 to 0.04% of C, 0.07 to 0.3% of Si, 1.0 to 2.0% of Mn, 0.1 to 0.3% of P, the remainder of Fe and other unavoidable impurities, and a 90% or more of ferrite area fraction and the remainder of pearlite within a region from a center of a cross section perpendicular of a longitudinal direction to 0.95*r, where r is a radius of the wire rod, wherein an average ferrite grain size may be 30 μm or less, and a pearlite colony size may be 10 μm or less.

Modes of the Invention

Embodiments of the disclosure will now be described. The embodiments of the disclosure, however, may be modified into many different forms and should not be construed as being limited to the embodiments set forth herein. The embodiments of the disclosure are provided to fully convey the idea provided in the disclosure to scope of the invention to those of ordinary skill in the art.

Terms as herein used are just for illustration. For example, the singular expressions include plural expressions unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms used herein have the same meaning as commonly understood by those of ordinary skill in the art to which the disclosure belongs. Furthermore, unless otherwise clearly defined, a specific term should not be construed as having overly ideal or formal meaning. It is to be understood that the singular expression include plural expressions unless the context clearly dictates otherwise.

Throughout the specification, the word 'about', 'substantially' or the like, is used to indicate that a numerical value used with the word belongs to a range around the numerical value, to prevent an unscrupulous pirate from unduly making an advantage of a description in which the absolute numerical value is mentioned.

Throughout the specification, the term "(crystal) grain size" or "colony size" may refer to the equivalent circular diameter (ECD) of a crystal grain or a colony.

In an embodiment of the disclosure, a wire rod for concrete reinforcing steel fiber may include, in percent by weight (wt %), 0.01 to 0.04% of C, 0.07 to 0.3% of Si, 1.0 to 2.0% of Mn, 0.1 to 0.3% of P, the remainder of Fe and other unavoidable impurities.

The reason for limiting the composition of the wire rod for concrete reinforcing steel fiber will now be described in detail. The reason for limiting the alloy composition of a concrete reinforcing steel fiber according to the disclosure is the same as that of the wire rod, so the description is omitted for convenience.

The content of C is 0.01 to 0.04 wt %.

C is an element constituting cementite and is an element that effectively increases strength when forming a pearlite structure. To secure a target strength, the C content is added in 0.01 wt % or more in the disclosure. However, if the C content is excessive, a pearlite structure is formed between the ferrites and an increase in pearlite colony fraction may cause breakage during the wire drawing, and intergranular corrosion resistance deteriorates as the grain boundary between the hard phase and the soft phase becomes clearer. Considering this, an upper limit of the C content may be limited to 0.04 wt % in the disclosure.

The content of Si is 0.07 to 0.3 wt %.

Si is a ferrite-hardening element that increases tensile strength by about 15 to 20 MPa per 0.1 wt % of the added content, and serves as a deoxidizer to remove oxygen from the molten steel. Taking this into account, 0.07 wt % or more of the Si content are added in the disclosure. However, if the Si content is excessive, a large amount of $Fe_2SiO_4$, which has excellent bonding power with a base material, may be formed, possibly leading to poor scale exfoliation, so the upper limit of the Si content is limited to 0.3 wt % in the disclosure.

The content of Mn is 1.0 to 2.0 wt %.

Mn is added in 1.0 wt % or more to increase strength of the wire rod. However, if the Mn content is excessive, process breakage is likely to occur due to segregation, so the upper limit of the Mn content is limited to 2.0 wt %.

The content of P is 0.1 to 0.3 wt %.

P is the most effective element to increase the strength after C and N. To secure the target strength, P is added in 0.1 wt % or more. However, if the P content is excessive, it may cause fracture due to surface crack formation during continuous casting, so the upper limit of the P content is limited to 0.3 wt % in the disclosure.

The remaining component is iron (Fe) in the disclosure. This may not be excluded because unintended impurities may be inevitably mixed from raw materials or surroundings in the normal manufacturing process. These impurities may be known to anyone skilled in the ordinary manufacturing process, so not all of them are specifically mentioned in this specification.

In an embodiment of the disclosure, the wire rod for concrete reinforcing steel fiber may satisfy the aforementioned alloy composition and the following Formula (1):

$$TS_{WR}-8(120[C]+14[Si]+20[Mn]+100[P])\geq 0$$

In Formula (1), [C], [Si], [Mn] and [P] each refer to percent by weight (wt %) of the element, and $TS_{WR}$ refers to tensile strength of the wire rod.

Formula (1) Formulates the correlation between the tensile strength of the wire rod and the alloy component content, which affects the strength of the final product of steel fiber, and is derived by taking into account the solid solution strengthening by addition of alloy components and the strengthening based on the grain size. In the disclosure, it is desirable to satisfy Formula (1) in terms of strengthening the strength of the steel fiber.

In an embodiment of the disclosure, the wire rod for concrete reinforcing steel fiber may include a 90% or more of ferrite area fraction and the remainder of pearlite within a region from the center of a cross section perpendicular to the longitudinal direction to 0.95*r, where r is a radius of the wire rod. In the disclosure, target strength is secured by limiting the pearlite structure that is formed with 0.04 wt % or less of low carbon steel having a low C content at the grain boundary and that may cause breakage during wire drawing, having the main structure of the steel formed with ferrite as described above, and then using a solid solution reinforcing element. If the area fraction of ferrite is less than 90% or the area fraction of pearlite exceeds 10%, breakage is likely to occur in wire drawing.

In an embodiment of the disclosure, the average ferrite grain size may be 30 μm or less, and the pearlite colony size may be 10 μm or less. The smaller the average ferrite grain size, the more advantageous it is for strength, and the smaller the pearlite colony size, the more advantageous it is for wire drawing performance, because pearlite colonies may act as crack formation sites during the wire drawing. In light of this, the average ferrite grain size may be 15 μm or less and the pearlite colony size may be 5 μm or less in an embodiment of the disclosure. According to an embodiment of the disclosure, refinement of crystal grains may be performed through finishing rolling performed in a 2-phase section.

The wire rod for concrete reinforcement according to the disclosure has excellent scale exfoliation property. For example, a scale layer formed on the surface may have a thickness of 10 to 15 μm, a total scale amount may be 0.4 to 0.6 wt %, and a residual scale amount after mechanical exfoliation may be 0.05 wt % or less.

The wire rod for concrete reinforcing steel fiber may have a tensile strength of 450 MPa or more.

The wire rod for concrete reinforcing steel fiber may have a cross section reduction ratio of 80% or more.

A method of manufacturing a wire rod for concrete reinforcing steel fiber according to the disclosure will now be described in detail. The wire rod for concrete reinforcing steel fiber as described above may be manufactured in various methods, and it is noted that the manufacturing method is not specifically limited.

In an embodiment of the disclosure, a method of manufacturing a wire rod for concrete reinforcing steel fiber may include heating a billet including the aforementioned ally composition, preparing a wire rod by hot rolling the billet at 1000 to 1150° C. or finishing rolling the billet at A3-70° C. to A3° C., winding the prepared wire rod, and cooling the wound wire rod.

The billet may be heated at 1000 to 1200° C.

The heated billet may be hot-rolled at 1000 to 1150° C., or finishing-rolled at A3-70° C. to A3° C. to be prepared as a wire rod. Finishing rolling performed in the 2-phase (ferrite and pearlite) section of A3-70° C. to A3° C. may refine the average ferrite grain size and pearlite colony size to further increase the strength and reduce the number of voids occurring at the grain boundary, thereby preventing occurrence of process breakage. In general, as the C content increases, the pearlite is formed better the pearlite colony size becomes coarser, causing breakage during wire drawing. In light of this, finishing rolling may prevent the breakage during the wire drawing by refining the pearlite colony size even with the C content being in a relatively high range of 0.02 to 0.04 wt %.

In an embodiment, the average ferrite grain size of the wire rod prepared by hot rolling at 1000 to 1150° C. may be 30 μm or less, and the pearlite colony size may be 10 μm or less.

In another embodiment, the average ferrite grain size of the wire rod prepared by finishing rolling at A3-70° C. to A3° C. may be 15 μm or less, and the pearlite colony size may be 5 μm or less.

The prepared wire rod is wound, and cooled to A1° C. at 1 to 5° C./s and then cooled from A1° C. to 200° C. at 15 to 20° C./s. Among scales of the wire rod, FeO (Wustite) is relatively easily removed as compared to $Fe_3O_4$(Magnetite). As FeO grows rapidly at a temperature of A1° C. or higher, the FeO layer having a sufficient thickness may be formed by slowly cooling it up to A1° C. at 1 to 5° C./s. To suppress the transformation of FeO into $Fe_3O_4$ from A1° C. to 200° C., FeO fraction of the scale layer may be maintained until the room temperature is reached by rapidly cooling it at 15 to 20° C./s. The wire rod for concrete reinforcing steel fiber manufactured as described above has an improved scale exfoliation property. A1° C. varies depending on the alloy composition, and is about 720° C. in the disclosure.

A method of manufacturing the wire rod for concrete reinforcing steel fiber according to an embodiment of the disclosure may satisfy the following Formula (2):

$$TE-TL/H\leq 100^\circ C. \quad (2)$$

In Formula (2), TE is a wire rod surface temperature before entering finishing rolling, and TL/H is a temperature of a winder. In Formula (2), product material deviation may be lowered and formation of a low temperature transformation structure may be suppressed by reducing the difference between the winder temperature and the surface temperature of the wire rod before entering the finishing rolling. In a way of reducing the temperature difference, water spraying may be lessened or cooling may be performed for a short period of time after hot rolling.

The wire rod undergoes dry drawing and wet drawing, cutting and molding to be manufactured into steel fibers. The wire rod may be manufactured by including dry drawing and wet drawing steps with a total reduction ratio of 99% or more, and the breakage rate during the drawing may be 0.5 times/ton or less. In addition, LP heat treatment for imparting ductility to the steel material between dry drawing and wet drawing may be omitted.

In an embodiment of the disclosure, a concrete reinforcing steel fiber may have the aforementioned alloy composition and satisfy the following Formula (3):

$$TS_F - TS_{WR} - [15/(1.5*FGS^{0.1})]*e^{4.61} \geq 0 \quad (3)$$

In Formula (3), $TS_F$ refers to tensile strength of steel fiber, $TS_{WR}$ refers to tensile strength of the wire rod, and FGS refers to an average ferrite crystal grain size. The tensile strength of steel wire and steel fiber is determined mainly by the strength of the wire rod and the grain size of the steel after wire drawing, and in particular by an increase in strength by the applied process amount rather than an increase in strength by solid solution strengthening. According to the disclosure, the micro-sized ferrite is rotated in the longitudinal direction and then changed into a long-lined fiber structure of several tens of nanometers, and thus, the strength is significantly increased. Formula (3) deduces the correlation between tensile strength of the steel fiber, tensile strength of the wire rod, and the average ferrite grain size by reflecting the aforementioned factors. In the disclosure, it is desirable to satisfy Formula (3) in terms of strengthening the strength of the steel fiber.

In an embodiment of the disclosure, the concrete reinforcing steel fiber may have a tensile strength of 1600 MPa or more.

The disclosure will now be described in more detail in the following embodiment of the disclosure. The following embodiment, however, is an illustrative example to describe the disclosure in more detail, and should not be construed as limiting the scope of the disclosure. The scope of the disclosure is defined by the claims and their equivalents.

Embodiment

Steel having the alloy composition shown in Table 1 below was manufactured in an electric furnace, and then cast to produce a 160×160 $mm^2$ cast billet. The billet was heated by maintaining a temperature of 1090° C. for 90 minutes in a heating furnace, and then subject to finishing rolling at the finishing rolling temperature of Table 1 to prepare a wire rod. The prepared wire rod was wound at 910° C., cooled from the winding temperature to A1° C. at the cooling rate in Table 1, and then cooled from A1° C. to 200° C. at 18° C./s.

TABLE 1

| | alloy composition (wt %) | | | | finishing rolling temperature | winding temperature~A1 temperature cooling rate |
|---|---|---|---|---|---|---|
| | C | Si | Mn | P | (° C.) | (° C./s) |
| Comparative example 1 | 0.005 | 0.28 | 1.5 | 0.2 | A3 − 59 | 3 |
| Example 1 | 0.02 | 0.28 | 1.5 | 0.2 | A3 − 50 | 4 |
| Example 2 | 0.03 | 0.28 | 1.5 | 0.2 | A3 − 50 | 5 |
| Example 3 | 0.04 | 0.28 | 1.5 | 0.2 | A3 − 60 | 2 |
| Comparative example 2 | 0.05 | 0.28 | 1.5 | 0.2 | A3 − 66 | 3 |
| Comparative example 3 | 0.02 | 0.39 | 1.5 | 0.2 | A3 − 52 | 5 |
| Example 4 | 0.02 | 0.28 | 1.8 | 0.2 | A3 − 60 | 4 |
| Comparative example 4 | 0.02 | 0.28 | 2.2 | 0.2 | A3 − 60 | 5 |
| Example 5 | 0.02 | 0.28 | 1.5 | 0.25 | A3 − 65 | 3 |
| Comparative example 5 | 0.02 | 0.28 | 1.5 | 0.35 | A3 − 65 | 2 |
| Comparative example 6 | 0.04 | 0.28 | 1.5 | 0.2 | A3 + 120 | 3 |
| Comparative example 7 | 0.02 | 0.28 | 1.5 | 0.2 | A3 − 50 | 22 |

The ferrite average grain size (FGS) of the produced wire rod, pearlite colony size, wire rod tensile strength, cross section reduction ratio, residual scale amount, total scale amount, and values of the left side of Formula (1) are shown in Table 2 below.

TABLE 2

| | FGS (μm) | pearlite colony size (μm) | wire rod tensile strength (MPa) | cross section reduction ratio (%) | residual scale amount (wt %) | total scale amount (wt %) | Formula (1) left side |
|---|---|---|---|---|---|---|---|
| Comparative example 1 | 9 | 0 | 409 | 91 | 0.03 | 0.58 | −27.16 |
| Example 1 | 13 | 0 | 519 | 89 | 0.02 | 0.55 | 68.44 |
| Example 2 | 12.5 | 3 | 523 | 86 | 0.03 | 0.5 | 62.84 |
| Example 3 | 13 | 5 | 545 | 84 | 0.04 | 0.58 | 75.24 |
| Comparative example 2 | 13 | 7 | 548 | 78 | 0.03 | 0.57 | 68.64 |
| Comparative example 3 | 12.2 | 0 | 528 | 88 | 0.06 | 0.49 | 65.12 |
| Example 4 | 12.6 | 0 | 605 | 85 | 0.01 | 0.55 | 106.44 |
| Comparative example 4 | 15.2 | 0 | 697 | 79 | 0.03 | 0.54 | 134.44 |
| Example 5 | 13 | 0 | 617 | 86 | 0.02 | 0.56 | 126.44 |
| Comparative example 5 | 13.5 | 0 | 655 | 65 | 0.02 | 0.55 | 84.44 |
| Comparative example 6 | 35 | 6 | 540 | 85 | 0.03 | 0.61 | 70.24 |
| Comparative example 7 | 12.2 | 0 | 498 | 82 | 0.07 | 0.52 | 47.44 |

Scales were removed from the cooled wire rod by using a mechanical exfoliation method, and then the wire rode underwent reduction at a total reduction ratio of 990% by applying a reduction ratio of 87% for dry drawing and 92% for wet drawing without intermediate LP heat treatment. It was then cut and molded into steel fibers. Table 3 shows the tensile strength, surface crack occurrence, and breakage rate during wire drawing of the manufactured steel fibers. In Table 3, "-" means no measurement result due to breakage

TABLE 3

| | steel fiber tensile strength (MPa) | surface crack occurrence (yes/no) | breakage rate (times/ton) |
|---|---|---|---|
| Comparative example 1 | 1430 | no | 0.2 |
| Example 1 | 1669 | no | 0.3 |
| Example 2 | 1673 | no | 0.1 |
| Example 3 | 1695 | no | 0.2 |
| Comparative example 2 | — | — | 8.1 |
| Comparative example 3 | — | — | 0.3 |
| Example 4 | 1755 | no | 0.4 |
| Comparative example 4 | — | — | 0.2 |
| Example 5 | 1767 | no | 0.2 |
| Comparative example 5 | — | — | 0.5 |
| Comparative example 6 | — | — | 18 |
| Comparative example 7 | 1648 | no | 6.8 |

Referring to Tables 1 to 3, the Examples and Comparative Examples are Compared for Evaluation. C Effect: Comparative Examples 1 and 2

In the Example, the C content satisfied the range of 0.01 to 0.04 wt % to increase wire rod strength, and the breakage during the wire drawing was 0.5 times/ton or less, so the wire drawing workability was excellent. On the other hand, comparative example 1 obtained a strength of 1430 Ma and failed to secure the target strength, and in comparative 2, the C content was excessive, causing breakage.

Si Effect: Comparative Example 3

In the comparative example 3, the Si content exceeded 0.3 wt % and had 0.06 wt % of a residual scale amount, which was poor as compared to other embodiments. Furthermore, in the comparative example 3, the wire rod had a breakage rate of 8 times/ton during the wire drawing, so the wire drawing workability was poor.

Mn Effect: Comparative Example 4

In comparative example 4, the Mn content exceeded 2.0 wt %, causing segregation and low-temperature structure, and thus caused breakage during the wire drawing.

P Effect: Comparative Example 5

In comparative example 5, the P content was excessive, causing lots of breakage during the wire drawing.

Finishing Rolling Temperature Effect: Comparative Example 6

In comparative example 6, a relatively large amount of C was contained, and finishing rolling was performed outside the 2-phase range of A3-70° C. to A3° C. As a result, pearlite colonies were coarsely formed and disconnected during the wire drawing.

Winding Temperature~A1 Temperature Cooling Rate Effect: Comparative Example 7

In the comparative example 7, rapid cooling was performed from the winding temperature to A1 temperature, forming relatively small FeO fracture that is easily removed, so the scale exfoliation property was poor. As a result, a large amount of residual scales were formed as compared to the Example.

Formula (1) Effect: Comparative Example 1

The comparative example 1 did not satisfy the Formula (1) and failed to secure the target strength.

Embodiments of the disclosure have thus far been described, but the disclosure is not limited thereto, and it will be obvious to those of ordinary skill in the art that various modifications and alterations can be made without deviating from the scope of the appended claims.

INDUSTRIAL APPLICABILITY

According to an embodiment of the disclosure, a wire rod for concrete reinforcing steel fiber, a steel fiber, and a method for manufacturing the same may be provided to omit lead patenting (LP) heat treatment to secure high strength and at the same time, reduce cost.

The invention claimed is:

1. A wire rod for concrete reinforcing steel fiber comprising:

in percent by weight (wt %), 0.01 to 0.04% of C, 0.07 to 0.3% of Si, 1.0 to 2.0% of Mn, 0.1 to 0.3% of P, the remainder of Fe and other unavoidable impurities, and a 90% or more of ferrite area fraction and the remainder of pearlite within a region from a center of a cross section perpendicular of a longitudinal direction to 0.95*r, where r is a radius of the wire rod, wherein an average ferrite grain size is 30 μm or less, and wherein a pearlite colony size is 10 μm or less.

2. The wire rod of claim 1, satisfying the following Formula (1):

$$TS_{WR}-8(120[C]+14[Si]+20[Mn]+100[P])\geq 0 \quad (1)$$

(in Formula (1), [C], [Si], [Mn] and [P] each refer to wt % of the element, and $TS_{WR}$ refers to tensile strength of the wire rod).

3. The wire rod of claim 1, wherein the average ferrite grain size is 15 μm or less, and wherein the pearlite colony size is 5 μm or less.

4. The wire rod of claim 1, wherein a scale layer formed on a surface thickness is 10 to 15 μm, a total scale amount is 0.4 to 0.6 wt %, and a residual scale amount after mechanical exfoliation is 0.05 wt % or less.

5. The wire rod of claim 1, wherein tensile strength is 450 MPa or more.

6. The wire rod of claim 1, wherein a cross section reduction ratio is 80% or more.

7. A method of manufacturing a concrete reinforcing steel fiber characterized by manufacturing the steel fiber by including dry wire drawing and wet wire drawing of the wire rod according to claim 1 with a total reduction ratio of 99% or more, wherein a breakage rate during the drawing is 0.5 times/ton or less.

8. A method of manufacturing a wire rod for concrete reinforcing steel fiber, the method comprising:

heating a billet comprising, in percent by weight (wt %), 0.01 to 0.04% of C, 0.07 to 0.3% of Si, 1.0 to 2.0% of Mn, 0.1 to 0.3% of P, the remainder of Fe and other unavoidable impurities; and preparing a wire rod by hot rolling the billet at 1000 to 1150° C. or finishing rolling the billet at A3-70° C. to A3° C.;

winding the prepared wire rod; and cooling the wound wire rod to A1° C. at 1 to 5° C./s and then cooling at 15 to 20° C./s from A1° C. to 200° C.

9. The method of claim 8, satisfying the following Formula (2):

$$TE-TL/H \leq 100° C. \quad (2)$$

(in Formula (2), TE is a wire rod surface temperature before entering finishing rolling, and TL/H is a temperature of a winder).

10. The method of claim 8, wherein the wire rod prepared by hot rolling at 1000 to 1150° C. has an average ferrite grain size of 30 μm or less and a pearlite colony size of 10 μm or less.

11. The wire rod of claim 8, wherein the wire rod prepared by finishing rolling at A3-70° C. to A3° C. has an average ferrite grain size of 15 μm or less and a pearlite colony size of 5 μm or less.

12. A concrete reinforcing steel fiber comprising:

in percent by weight (wt %), 0.01 to 0.04% of C, 0.07 to 0.3% of Si, 1.0 to 2.0% of Mn, 0.1 to 0.3% of P, the remainder of Fe and other unavoidable impurities, wherein the concrete reinforcing steel fiber satisfies the following Formula (3):

$$TS_F - TS_{WR} - [15/(1.5*FGS^{0.1})]*e^{4.61} \geq 0 \quad (3)$$

(in Formula (3), $TS_F$ refers to tensile strength of steel fiber, $TS_{WR}$ refers to tensile strength of the wire rod, and FGS refers to an average ferrite crystal grain size).

13. The concrete reinforcing steel fiber of claim 12, wherein tensile strength is 1600 MPa or more.

* * * * *